United States Patent [19]

Mizelle

[11] Patent Number: 4,709,906

[45] Date of Patent: Dec. 1, 1987

[54] FURNITURE SEAT SUPPORTS AND SPRING ASSEMBLIES

[76] Inventor: Ned W. Mizelle, P.O. Box 5985, High Point, N.C. 27262

[21] Appl. No.: 917,863

[22] Filed: Oct. 14, 1986

[51] Int. Cl.[4] ..... F16F 3/00

[52] U.S. Cl. ..... 267/103; 267/106; 267/107; 267/109; 267/110; 267/142

[58] Field of Search ..... 267/144, 142, 146, 147, 267/85, 91, 97, 100, 101, 102, 103, 104, 105–112, 131–133; 5/247, 255; 297/452

[56] References Cited

U.S. PATENT DOCUMENTS

| | | | |
|---|---|---|---|
| 2,643,705 | 6/1953 | Neely | 267/144 |
| 2,773,543 | 12/1956 | Sandor | 267/107 |
| 2,815,797 | 12/1957 | Flint | 267/106 |
| 2,856,989 | 10/1958 | Pawlikowski | 267/106 |
| 2,934,133 | 4/1960 | Pawlikowski | 267/106 X |
| 3,888,474 | 6/1975 | Mandusky et al. | 267/110 |
| 4,357,005 | 11/1982 | Bourke | 267/144 |
| 4,426,070 | 1/1984 | Garceau et al. | 267/110 X |
| 4,619,445 | 10/1986 | Sasaki | 267/103 X |
| 4,636,006 | 1/1987 | Kazaoka et al. | 267/142 X |

*Primary Examiner*—Douglas C. Butler

*Attorney, Agent, or Firm*—Beveridge, DeGrandi & Weilacher

[57] ABSTRACT

A resilient furniture seat support is provided with spring assemblies formed of base springs which have upper springs mounted thereon. Each base spring is formed of a length of wire with forward and rear mounting portions which are connectible to the front and rear rails of a seat frame. The upper springs have base portions connected to and supported by the base spring, resilient vertically collapsible midportions, and upper attachment portions adapted for attachment to transverse border wires or crosswires. Two upper springs have their attachment portions connected together. The base spring has a resilient vertically collapsible section, and an attachment portion is located at the upper end of this collapsible section. The upper attachment portion of the base spring is attached to the upper attachment portion of one of the upper springs.

51 Claims, 14 Drawing Figures

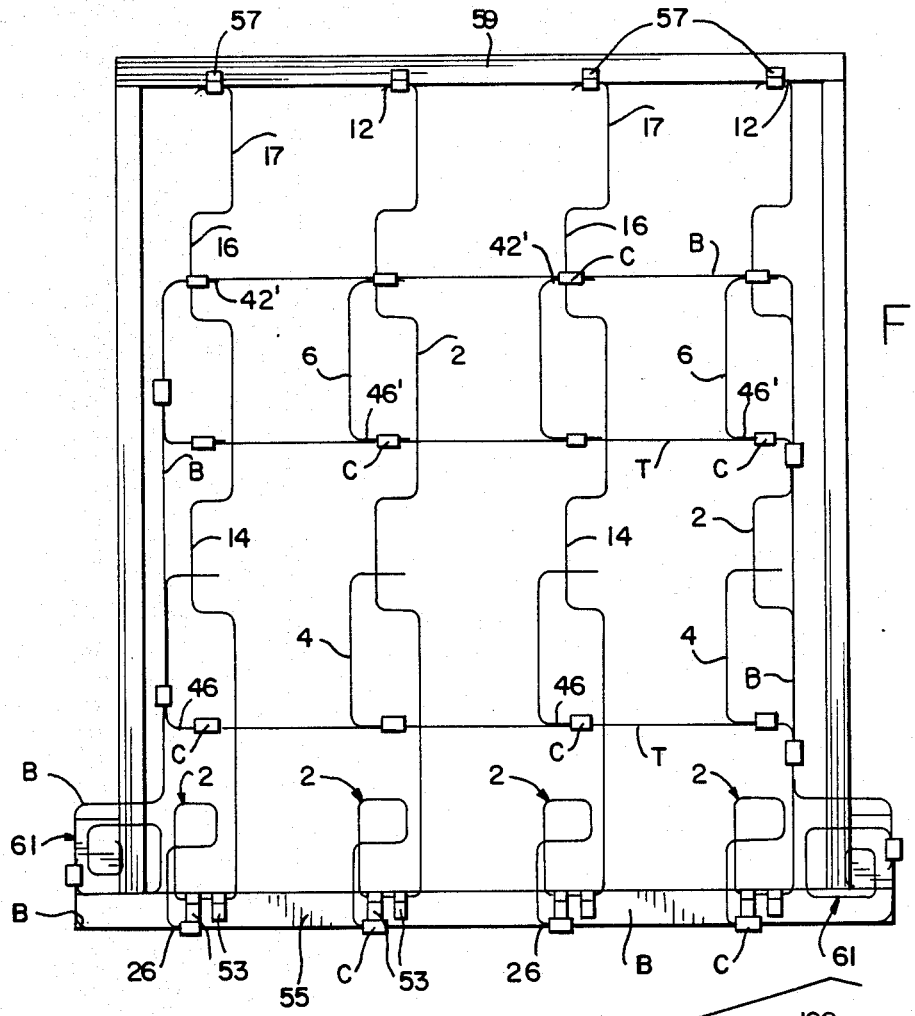
FIG. 3
FIG. 4
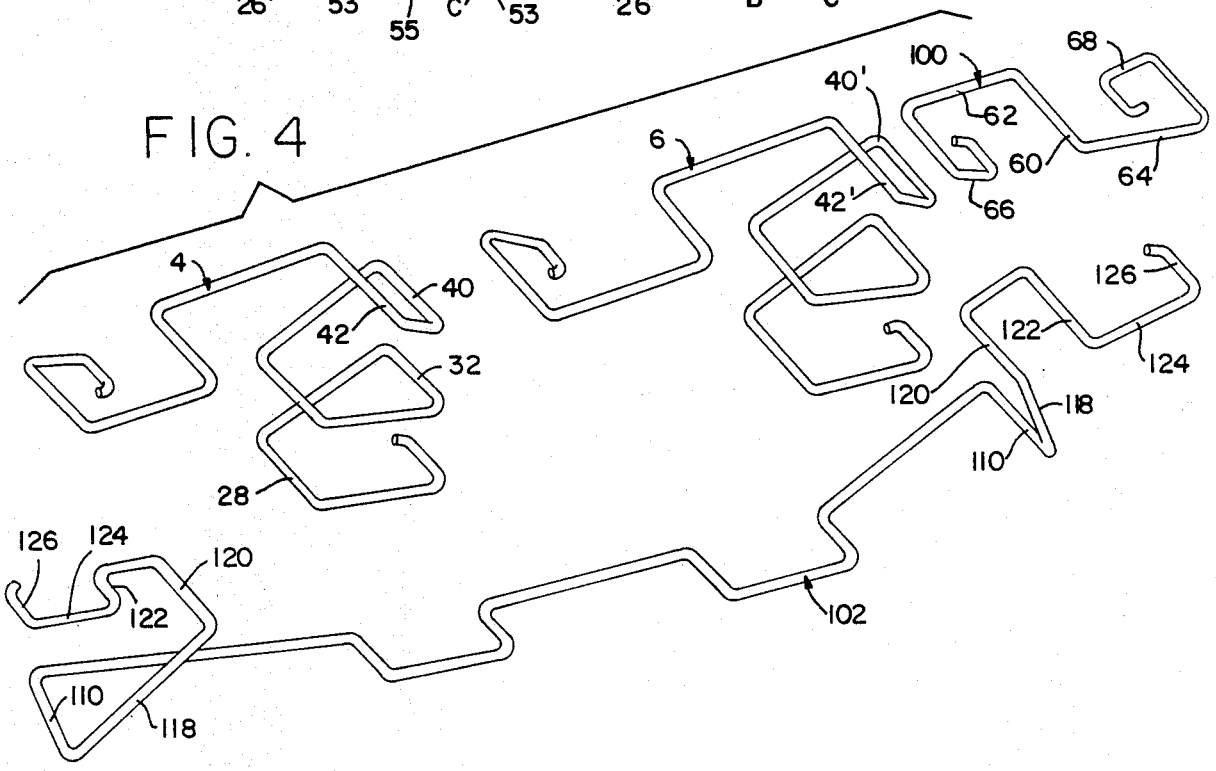

4
2
12
17
17'
16
14
13
13'
10
18
20
22
24
26
28
30
32
34
36
38
40
42
44
46
48
50
52

FIG 9
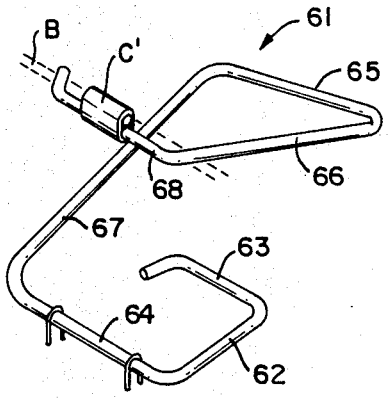
FIG 10
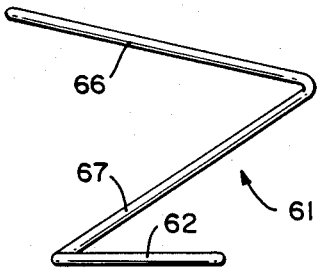
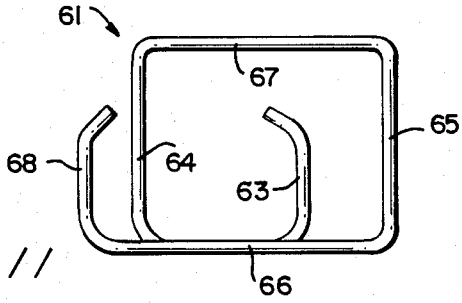
FIG 11
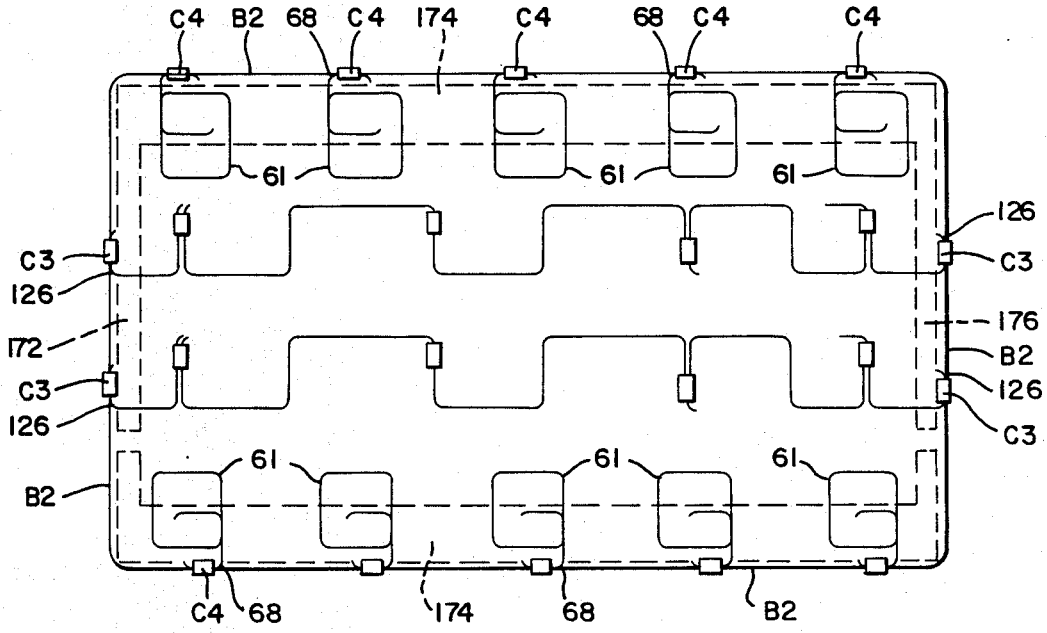
FIG 12

FURNITURE SEAT SUPPORTS AND SPRING ASSEMBLIES

BACKGROUND OF THE INVENTION

This invention relates to furniture seat structures and to spring assemblies which are utilized in such structures.

High quality furniture often is provided with a seat frame which has a plurality of coil springs mounted therein, and these coil springs are tied together in eight different directions so as to precompress them and limit their lateral movement with respect to each other. The manufacture of such units is a time consuming and expensive task due to the numerous steps which must be performed manually by skilled workers.

The present invention provides a modern alternative to expensive hand tied spring assemblies. The spring characteristics are comparatively quite favorable, the overall cost is less, and the unit can be manufactured by workers who are less skilled and experienced. Further, some of the springs used in the present system are interchangeable between several different units, thereby reducing the number of components which must be stocked by a manufacturer. The design is readily adaptable to the formation of seats of differing depths, and the modifications can be made to the seats without adversely affecting the seating qualities of the unit. A different sized seat can be produced simply by changing the border wire.

Spring assemblies constructed according to the invention also exert considerably less force on seat frames than many spring designs presently in use. In this respect, the invention makes it possible to use less expensive lightweight frames. Moreover, fatigue tests have shown that the units of the present invention are extremely durable.

The advantages of the invention, and its adaptability to the furniture industry will be evident from a study of the accompanying drawings and detailed description.

SUMMARY OF THE INVENTION

The spring assemblies constructed according to the invention are intended to be mounted in side by side relationship, extending longitudinally from the front rail to the rear rail of a substantially horizontal seat frame.

Each spring assembly is formed of a base spring with at least two upper springs mounted thereon. The base spring is formed of a length of wire which has a forward mounting portion which is connectible to a front rail of a seat frame, a rear mounting portion which is connectible to a rear rail of a seat frame, and spaced apart support portions which are located between the forward mounting portion and the rear mounting portion.

The upper springs have lower bases which are mounted on the support portions of the base spring. The upper springs also have resilient vertically collapsible midportions, and upper attachment portions. According to one main feature of the invention, the upper attachment portion of one upper spring is connected to the upper attachment portion of another upper spring which is similarly supported on the base spring. According to another main feature of the invention, the upper attachment portion of an upper spring is attached to the base spring.

Preferably, both of the main features described in the preceding paragraph are used in each spring assembly. Additionally, it is possible to provide the front or rear of the base spring with a resilient vertically collapsible midportion with an attachment portion at its upper end for attachment to one of the upper attachment portions of an upper spring. The upper springs are substantially identical to each other, and their orientation and configuration are such that they flex and prestress the wire of the base spring. The upper attachment portion of one upper spring is located forwardly of the upper attachment portion of another such spring so that together they form a longitudinally extending seat support. Such springs are used in combination with a seat frame, with a plurality of such spring assemblies being located beside each other to provide a seat support. In such a situation, it is desirable to provide transverse tie wires which connect together the attachment portion of the springs. The spacing between the front and back rail of the frame is such that the spring assembly will become elongated in a longitudinal direction at the time it is connected to the seat frame.

In another respect, the invention involves a furniture seat structure which has a plurality of spring assemblies provided therein. Each spring assembly has a base spring and at least one upper spring mounted on the base spring. The base spring is bent to provide support portions for the upper springs at locations which lie between the forward and rear mounting portions of the spring. The upper springs have lower base portions connected to the support portions of the base spring, and the upper springs also have vertically collapsible midportions and upper attachment portions. The attachment portions of the upper springs have transverse bars which are connected to a transverse wire which extends across the seating unit to interconnect the plurality of transversely spaced upper springs for lateral stability. Preferably, there are at least two upper springs on each base spring, and the upper attachment portions of these upper springs are connected together. Also, it is preferred to connect the upper attachment portions of one of the upper springs to some point on its respective base spring. When the seat structure of the article of furniture has a border wire, supplemental springs on the seat frame may support the edges or corners of the border wire. For lateral stability, longitudinal sections of the upper springs are attached to the longitudinal portions of the border wire, and transverse sections of the upper springs can be connected by transverse tie wires to each other and to the longitudinal sides of the border wire.

For a further understanding of the invention, reference is made to the accompanying drawings and to the following description which are directed to but a few of the numerous forms the invention may take.

BRIEF DESCRIPTION OF THE DRAWINGS

FIG. 3 is a diagrammatic plan view of a furniture seat frame for a T-cushion chair, provided with spring assemblies of the type shown in FIG. 1.

FIG. 4 is an exploded isometric view of another embodiment of the invention.

FIG. 9 is a perspective view of a supplemental spring for supporting a border wire.

FIGS. 10 and 11 are side and plan views of the spring of FIG. 9.

FIG. 12 is a diagrammatic plan view of an ottoman which utilizes the springs shown in FIGS. 4 and 9.

DETAILED DESCRIPTION

Figure 1:
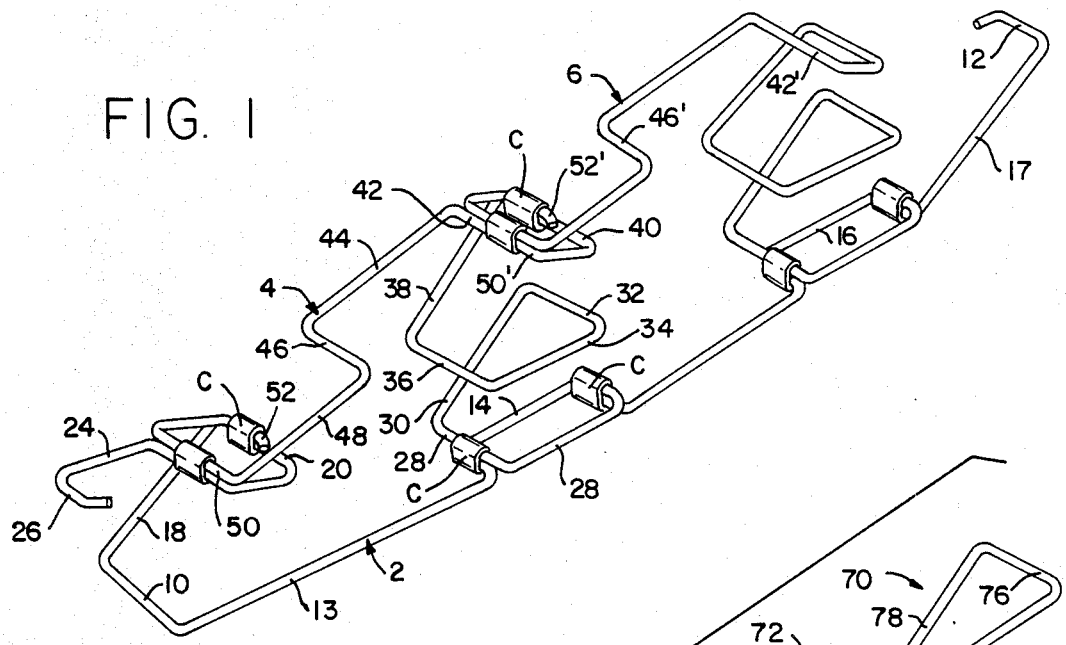
FIG. 1 is an isometric view of one embodiment of the invention.
Figure 2:
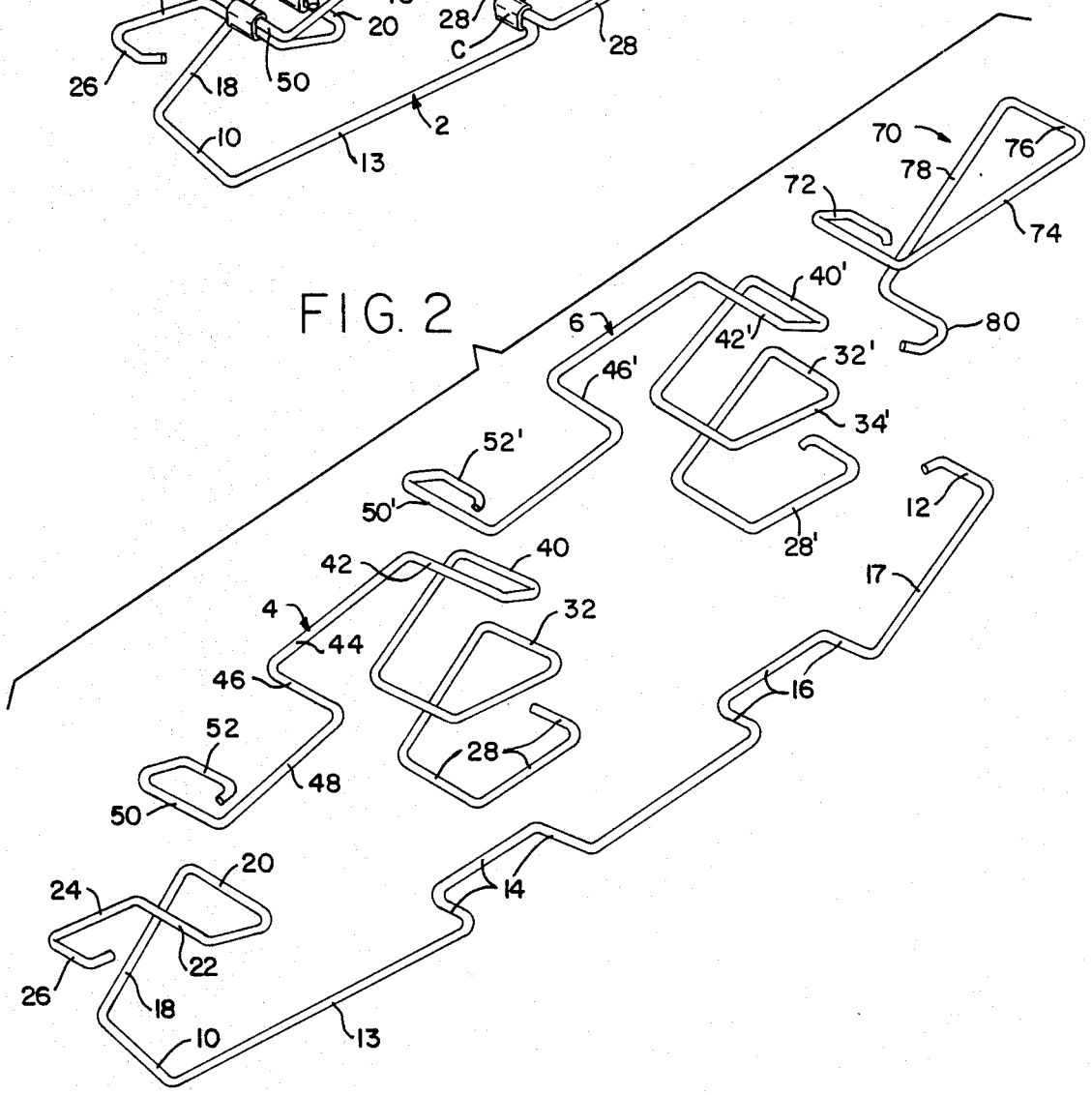
FIG. 2 is an exploded isometric view of the assembly shown in FIG. 1, but additionally showing a rear extension for the assembly.

Referring to FIGS. 1 and 2, it will be seen that the furniture spring assembly is formed of a base spring 2 and two upper springs 4 and 6. The base spring 2 has two transverse mounting bars 10 and 12 which are engaged by support clips on the front and rear rails of a furniture seat frame. In the section of the base spring located between the mounting bars 10 and 12, there is an inclined forward longitudinal bar 13, two U-shaped support portions 14 and 16 for supporting the bases of the upper springs 4 and 6, and an inclined rear longitudinal bar 17. Extending upwardly from the forward mounting bar 10, the base spring 2 is provided with a vertically collapsible section comprising a connector bar 18 which leads to the upper attachment portion of spring 2. This attachment portion includes a pair of transverse bars 20 and 22 which are connectible to the upper spring 4, and a forward extension 24 which leads to a short transverse bar 26 which is clipped to a front border wire to provide the article of furniture with a forwardly disposed spring edge.

The upper springs 4 and 6 are identical to each other. The spring 4 has a lower U-shaped base section 28 which is connected by clips to the support section 14 of the base spring 2. Extending upwardly from the base 28, the spring 4 has an inclined connector bar 30, a substantially horizontal transverse torsion bar 32, a further inclined connector bar 34, a second horizontal transverse torsion bar 36, and a third connector bar 38 which leads up to the attachment portion at the upper part of the spring. This attachment portion has a pair of horizontal transverse bars 40 and 42 which are connected by clips to the forward end of the spring 6. Extending forwardly from the bars 40 and 42, there is a longitudinal section 44, a transverse section 46 to which a tie wire may be clipped, and a longitudinal section 48 which leads to the U-shaped forward end of the attachment portion. This forward end has two transverse bars 50 and 52 which lie against and are clipped to the bars 20 and 22 on the upper attachment portion of the base spring 2.

The second upper spring 6 is substantially identical to the spring 4, so its components are identified by corresponding primed reference numerals. This second spring has the bars 50′ and 52′ at the forward end of its upper attachment portion duly clipped to the bars 40 and 42 in the attachment portion of spring 4.

Figures 5, 6, 7, 8:
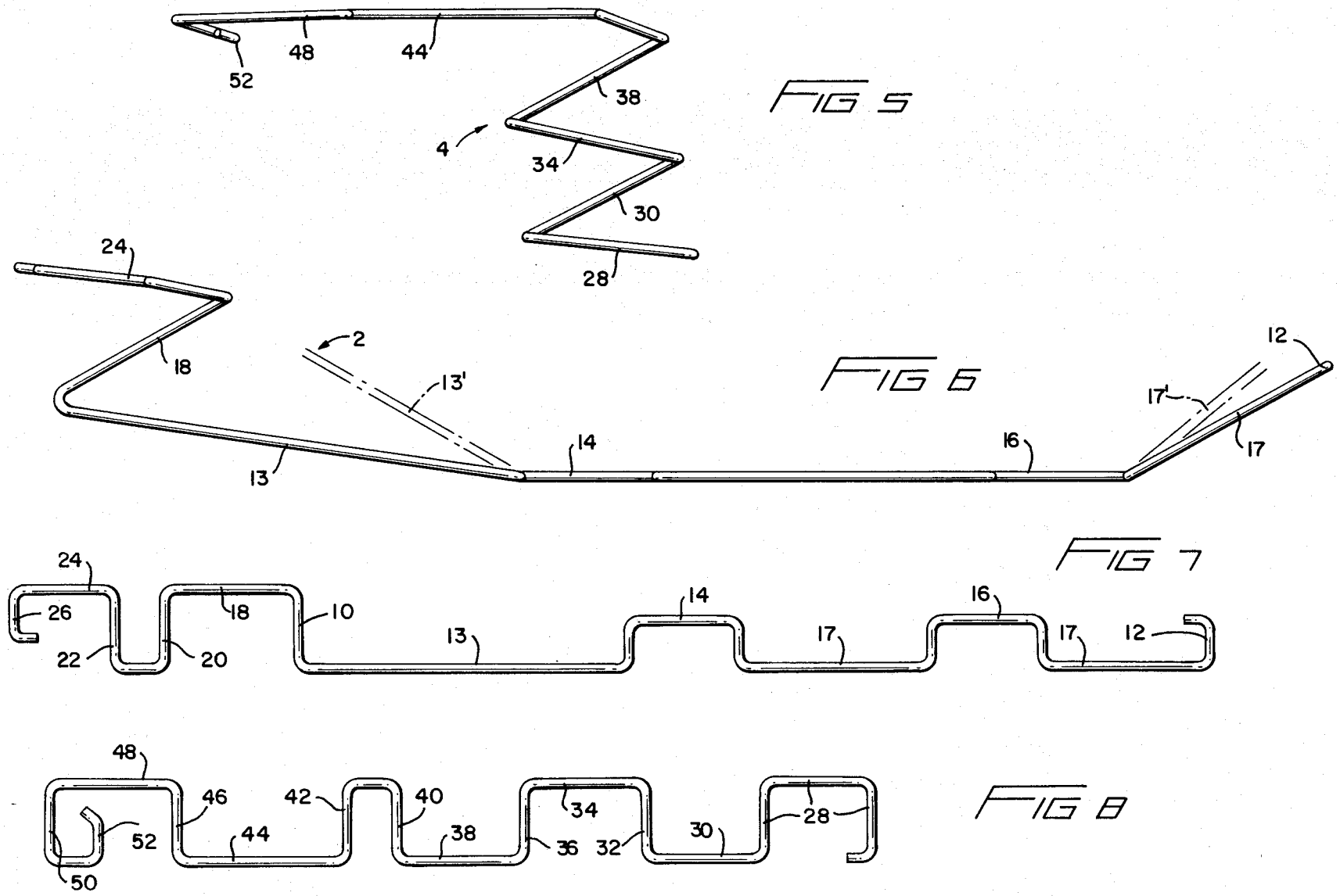
FIG. 5 is a side view of an upper spring used in the embodiment of FIG. 1.
FIG. 6 is a side view of a base spring used in the embodiment of FIG. 1.
FIG. 7 is a view of the wire fabric used to form the spring of FIG. 6.
FIG. 8 is a view of the wire fabric used to form the spring of FIG. 5.

FIGS. 5 and 6 show the springs 2 and 4 in the configuration they occupy when assembled. Prior to such assembly, bars 13 and 17 of base spring 2 have a somewhat greater inclination as shown in broken lines at 13′ and 17′. In the assembled unit, the springs 2, 4 and 6 are prestressed, and the bars 13 and 17 and the span between them are each slightly bowed in an upward direction. The distance between the mounting bars 10 and 12 in the assembled spring unit is slightly less than the distance between the mounting hooks which support them. Thus tension must be applied to elongate the spring assembly in the course of placing it on the hooks in the seat frame.

It will be appreciated that the spring assembly according to the invention has certain truss-like qualities in the respect that, when it is loaded, the base spring between bars 10 and 12 is under tension, and the upper regions of the unit are under compression.

As shown in FIG. 3, a plurality of spring assemblies are mounted in a seat frame where they extend from hooks 53 on the front rail 55 to hooks 57 on the back rail 59. Portions of the spring assemblies are not illustrated in this diagrammatic drawing. The seat support itself includes a border wire B and a plurality of transverse paper wrapped tie wires T which are clipped by clips C to the transverse bars 26, 46, 46′ and 42′ of the springs 2, 4 and 6 to enhance the lateral stability of the spring assemblies. Also to enhance lateral stability, the assemblies which are adjacent to the longitudinal sides of the border wire B have their longitudinal sections 44 and 44′ or 48 and 48′ clipped to the border wire.

The border wire B has a T shaped perimeter, and the laterally protruding segments thereof are supported by a pair of supplemental springs 61 stapled to side blocks of the seat frame. The upper ends of the springs 61 are connected to the border wire by clips C′.

One of the corner springs 61 is shown in FIGS. 9, 10 and 11 where it will be seen that it has a U-shaped base formed of a horizontal bar 62 and two parallel legs 63 and 64, the latter of which is placed under torsion when the spring is compressed. The vertically collapsible midportion of the spring includes a torsion bar 65 with connector bars 66 and 67 extending upwardly and downwardly from its opposite ends. At the upper end of the upper connector bar 66, there is a bar 68 which, with the clip C′, attaches the upper end of the spring 61 to the border wire B.

An optional component of the spring is shown in FIG. 2. It is the rear extension member 70 which makes it possible to provide a spring edge at the rear of the seat structure. This member 70 has a forward U-shaped attachment portion 72 which has a pair of transverse bars, a rearwardly extending horizontal longitudinal bar 74, a transverse bar 76 to which a rear border wire may be attached, and a downwardly and forwardly inclined connector bar 78 which extends to an L-shaped attachment bar 80. The legs of the forward attachment portion 72 are clippable to the bars 40′ and 42′ of spring 6, and the attachment bar 80 may be retained by two clips on the portions 32′ and 34′ of the spring 6.

The modified version of the invention shown in FIG. 4 is particularly suited for use in ottoman type furniture pieces, as it has spring edges at both the front and rear. In this version, the rear end of the base spring is modified, and there is an additional connector piece 100 in the upper region of the assembly.

The front end of base spring 102 is substantially a reversed version of the front end of base spring 2 shown in FIG. 1. The rear end of base spring 102 is substantially a mirror image of its front end. This rear end has a connector bar 118 which permits vertical collapsibility, and an upper attachment portion provided with a pair of transverse bars 120 and 122. Extending rearwardly from the bar 122, there is a rear extension 124 leading to a transverse bar 126 which is clippable to the rear border wire of the seating unit.

The connector piece 100 shown in FIG. 4 connects bars 40' and 42' on the rear spring 6 to the attachment bars 120 and 122 at the rear of the base spring. The connector piece 100 has a centrally located transverse bar 60 which has a pair of longitudinal bars 62 and 64 extending in opposite directions from its ends. At both ends of the connector piece 100, there are U-shaped attachment sections 66 and 68 having a pair of spaced apart bars which are clipped, respectively, to the attachment portion of spring 6 and to the attachment portion of the base spring 102.

FIG. 12 is a diagrammatic view of an ottoman 171 which utilizes spring assemblies 170 such as those shown in FIG. 4, together with the edge springs 61 of FIG. 9. The ottoman has a frame with a front rail 172, side rails 174 and a back rail 176, the perimeters of which are shown in broken lines. The side-to-side dimension of this frame is foreshortened for illustrative purposes in FIG. 12, but it will be appreciated by those skilled in the art that actual production units will have square frames and will have additional spring assemblies 170 to provide the necessary support.

The ottoman 171 has a rectangular border wire B2 with a front section connected by clips C3 to the bars 126 of the spring assemblies 170, side sections fastened by clips C4 to the bars 68 of edge springs 61, and a rear section clipped to the bars 126 of the spring assemblies 170. The edge springs 61 are stapled to the side rails 174 as shown in FIG. 9, and bars 110 of the assemblies 170, shown in FIG. 4, are attached to the front and rear rails 172, 176 of the seat frame by means of hooks of the type shown at 53 in FIG. 3. Due to these arrangements, it will be appreciated that the entire border wire B2 is resiliently supported on and is vertically movable with respect to the seat frame. For lateral stability, the ottoman of FIG. 12 may be provided with transverse wires such as those shown at T in FIG. 3, such transverse wires having their opposite ends clipped to the longitudinal sides of the border wire and having their midsections clipped to the transverse sections 42 and 46 of the spring assemblies.

Figure 13:
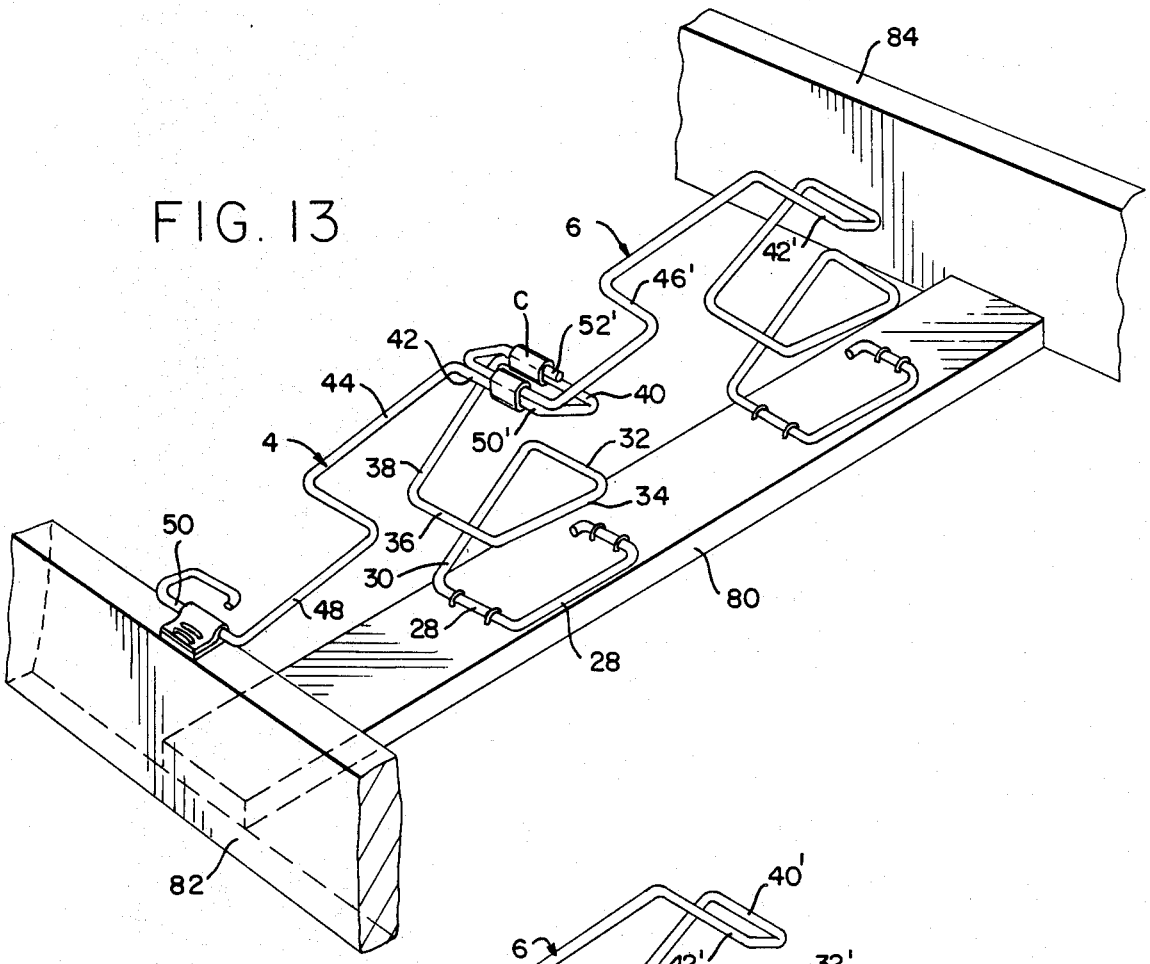
FIG. 13 is a view showing two of the upper springs mounted on a longitudinal spring rail.
Figure 14:
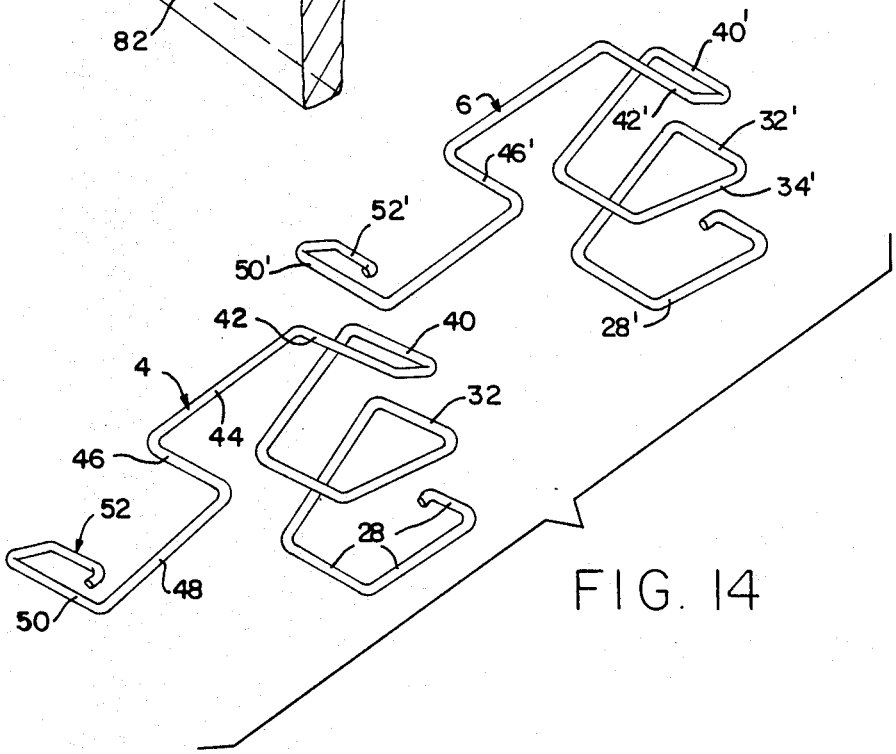
FIG. 14 is an exploded view of the two upper springs shown in FIG. 13.

Rather than mounting the upper springs 4 and 6 on a lower spring 2, it is possible to staple them to a spring rail 80 as shown in FIG. 13. The spring rail 80 extends longitudinally from the front rail 82 to the back rail 84. The bar 26 of spring 4 is attached to the upper edge of the front rail 82 by a spring clip 50 which is stapled to the frame.

Persons familiar with this art will realize that there are many possible modifications which the invention may take. Obviously, the components may have different configurations as, for example, the upper springs may have only one rather than two torsion bars in the vertically collapsible midportions thereof. The forward extension portions 24 and 26 may be omitted, and the unit may have a hard edge so that the border wire is not vertically yieldable. In view of the numerous possible forms of the invention, it is emphasized that the invention is not limited solely to the disclosed embodiments, but is embracing of many other arrangements which fall within the spirit of the following claims.

I claim:

1. A furniture spring assembly for forming a resilient seat support on a substantially horizontal seat frame, said spring assembly including a base spring and at least two upper springs mounted on said base spring, said base spring formed of a length of wire which has a forward mounting portion which is connectible to a front rail of a seat frame, said base spring also having a rear mounting portion which is connectible to a rear rail of the seat frame, said base spring extending longitudinally from the forward mounting portion to the rear mounting portion and being bent between and below the forward mounting portion and the rear mounting portion to form spaced apart support portions for supporting the upper springs, a first upper spring having a lower base portion, a resilient vertically collapsible midportion and an upper attachment portion, said lower base portion of the first upper spring being connected to one of the support portions of the base spring, a second upper spring having a lower base portion, a resilient vertically collapsible midportion and an upper attachment portion, said lower base portion of the second upper spring being connected to one of the support portions of the base spring, and means for connecting the upper attachment portion of the first upper spring to the upper attachment portion of the second upper spring.

2. A furniture spring assembly according to claim 1 wherein said upper springs are substantially identical to each other.

3. A furniture spring assembly according to claim 1 wherein said base spring also has a resilient vertically collapsible midportion with an attachment portion at the upper end thereof, said upper attachment portion of the base spring being connected to an upper attachment portion of an upper spring.

4. A furniture spring assembly according to claim 3 wherein said base spring has its vertically collapsible midportion extending upwardly from the forward mounting portion.

5. An article of furniture which includes a furniture spring assembly according to claim 1 in combination with and connected to a said seat frame, a plurality of said spring assemblies being located beside each other to provide a seat support.

6. An article of furniture according to claim 5 having transverse wires which connect together the attachment portions of said springs of different spring assemblies.

7. An article of furniture according to claim 5 having a border wire which is attached to and supported by said spring assemblies.

8. An article of furniture according to claim 7 wherein the upper attachment portion of at least one of said upper springs has a longitudinal section which is attached to the border wire to enhance the lateral stability of the spring assembly.

9. An article of furniture according to claim 8 having transverse wires which connect together the attachment portions of said spring of different spring assemblies to enhance further the lateral stability of said spring assemblies.

10. An article of furniture according to claim 8 having supplemental springs with lower portions mounted on the seat frame and upper portions connected to the border wire.

11. An article of furniture according to claim 8 wherein the border wire is T shaped.

12. An article of furniture according to claim 10 wherein the border wire has longitudinal sections and transverse sections, said spring assemblies having opposite ends which are connected to said transverse sections of the border wire for resilient support thereof, said supplemental springs being connected to the longitudinal sections for resilient support thereof.

13. A furniture spring assembly according to claim 1 wherein each support portion of the base spring has a pair of transverse wire sections, and the lower base portion of each of the upper springs has a pair of transverse wire sections, said transverse wire sections of the base spring being clipped to the transverse wire sections of the upper springs.

14. A furniture spring assembly according to claim 1 wherein the upper springs are constructed and oriented to flex and prestress the wire of the base spring.

15. A furniture spring assembly according to claim 1 in combination with a seat frame, said seat frame having front rail and a back rail which are spaced apart a distance which is greater than the distance between the forward mounting portion and the rear mounting portion of the base spring when the spring assembly is unconnected to the seat frame, said front rail and back rail being operable to elongate the spring assembly in a longitudinal direction when the spring assembly is connected to the seat frame.

16. A furniture spring assembly according to claim 1 wherein the resilient vertically collapsible midportions of the upper springs are formed of substantially linear torsion bars and substantially linear connector bars.

17. A furniture spring assembly according to claim 1 wherein one of the upper attachment portions is connected to said base spring, one of said upper attachment portions being located forwardly of the other upper attachment portion so that said attachment portions form a longitudinally extending seat support.

18. A furniture spring assembly according to claim 1 wherein at least one of the upper springs has a further transverse bar therein which permits the attachment of a transverse seat wire thereto.

19. A furniture spring assembly for forming a resilient seat support on a substantially horizontal seat frame, said spring assembly including a base spring and at least two upper springs mounted on said base spring, said base spring formed of a length of wire which has a forward mounting portion which is connectible to a front rail of a seat frame, said base spring also having a rear mounting portion which is connectible to a rear rail of the seat frame, said base spring extending longitudinally from the forward mounting portion to the rear mounting portion and being bent between and below the forward mounting portion and the rear mounting portion to form spaced apart support portions for supporting the upper springs, a first upper spring having a lower base portion, a resilient vertically collapsible midportion and an upper attachment portion, said lower base portion of the first upper spring being connected to one of the support portions of the base spring, a second upper spring having a lower base portion, a resilient vertically collapsible midportion and an upper attachment portion, said lower base portion of the second upper spring being connected to one of the support portions of the base spring, and means for connecting one of the upper attachment portions to said base spring.

20. A furniture spring assembly according to claim 19 wherein said upper springs are substantially identical to each other.

21. A furniture spring assembly according to claim 19 wherein said base spring also has a resilient vertically collapsible midportion with an attachment portion at the upper end thereof, said upper attachment portion of the base spring being connected to an upper attachment portion of an upper spring.

22. A furniture spring assembly according to claim 21 wherein said base spring has its vertically collapsible midportion extending upwardly from the forward mounting portion.

23. An article of furniture which includes a furniture spring assembly according to claim 19 in combination with and connected to a said seat frame, a plurality of said spring assemblies being located beside each other to provide a seat support.

24. An article of furniture according to claim 19 having transverse wires which connect together the attachment portions of said springs of different spring assemblies.

25. An article of furniture according to claim 19 having a border wire which is attached to and supported by said spring assemblies.

26. An article of furniture according to claim 25 wherein the upper attachment portion of at least one of said upper springs has a longitudinal section which is attached to the border wire to enhance the lateral stability of the spring assembly.

27. An article of furniture according to claim 26 having transverse wires which connect together the attachment portions of said springs of different spring assemblies to enhance further the lateral stability of said spring assemblies.

28. An article of furniture according to claim 25 having supplemental springs with lower portions mounted on the seat frames and upper portions connected to the border wire.

29. An article of furniture according to claim 25 wherein the border wire is T shaped.

30. An article of furniture according to claim 28 wherein the border wire has longitudinal sections and transverse sections, said spring assemblies having opposite ends which are connected to said transverse sections of the border wire for resilient support thereof, said supplemental springs being connected to the longitudinal sections for resilient support thereof.

31. A furniture spring assembly according to claim 19 wherein each support portion of the base spring has a pair of transverse wire sections, and the lower base portion of each of the upper springs has a pair of transverse wire sections, said transverse wire sections of the base spring being clipped to the transverse wire sections of the upper springs.

32. A furniture spring assembly according to claim 19 wherein the upper springs are constructed and oriented to flex and prestress the wire of the base spring.

33. A furniture spring assembly according to claim 19 in combination with a seat frame, said seat frame having a front rail and a back rail which are spaced apart a distance which is greater than the distance between the forward mounting portion and the rear mounting portion of the base spring when the spring assembly is unconnected to the seat frame, said front rail and back rail being operable to elongate the spring assembly in a longitudinal direction when the spring assembly is connected to the seat frame.

34. A furniture spring assembly according to claim 19 wherein the resilient vertically collapsible midportions of the upper springs are formed of substantially linear torsion bars and substantially linear connector bars.

35. A furniture seat structure having a substantially horizontal seat frame and a plurality of spring assemblies mounted on said seat frame, said seat frame having a front rail and a rear rail, each of said spring assemblies including a base spring and at least one upper spring mounted on said base spring, each said base spring being formed of a length of wire which has a forward mounting portion which is connected to the front rail of the seat frame, each said base spring also having a rear mounting portion which is connected to the rear rail of the seat frame, said base springs extending longitudinally from the forward mounting portions to the rear mounting portions and being bent between the forward mounting portions and the rear mounting portions to form spaced apart support portions for supporting the upper springs, a plurality of upper springs each having a lower base portion, a resilient vertically collapsible midportion and an upper attachment portion, said lower base portions of the upper springs being connected to the support portions of the base spring, said attachment portions of the upper springs having transverse bars which are connected to a transverse wire to interconnect a plurality of transversely spaced upper springs.

36. A furniture seat structure according to claim 35 having at least two upper springs connected to a base spring, and means for connecting together the attachment portions of said two upper springs.

37. A furniture seat structure according to claim 35 wherein the upper attachment portions of the upper springs are connected to the respective said base springs.

38. A furniture seat structure according to claim 37 having at least two upper springs connected to a base spring, and means for connecting together the attachment portions of said two upper springs.

39. An article of furniture which includes a furniture seat structure according to claim 37 having a border wire which is attached to and supported by said spring assemblies.

40. An article of furniture according to claim 39 wherein the upper attachment portion of at least one of said upper springs has a longitudinal section which is attached to the border wire to enhance the lateral stability of the spring assembly.

41. An article of furniture according to claim 40 having transverse wires which connect together the attachment portions of said springs of different spring assemblies to enhance further the lateral stability of said spring assemblies.

42. An article of furniture according to claim 39 having supplemental springs with lower portions mounted on the seat frames and upper portions connected to the border wire.

43. An article of furniture according to claim 39 wherein the border wire is T shaped.

44. An article of furniture according to claim 42 wherein the border wire has longitudinal sections and transverse sections, said spring assemblies having opposite ends which are connected to said transverse sections of the border wire for resilient support thereof, said supplemental springs being connected to the longitudinal sections for resilient support thereof.

45. A furniture spring assembly for forming a resilient seat support on a substantially horizontal seat frame, said spring assembly including a base and at least two upper springs mounted on said base, said base having a forward portion which is connectible to a front rail of a seat frame, said base also having a rear portion which is connectible to a rear rail of the seat frame, said base extending longitudinally from the forward mounting portion to the rear mounting portion and having spaced apart support portions for supporting the upper springs, a first upper spring having a lower base portion, a resilient vertically collapsible midportion and an upper attachment portion, said lower base portion of the first upper spring being mounted on one of the support portions of the base, a second upper spring having a lower base portion, a resilient vertically collapsible midportion and an upper attachment portion, said lower base portion of the second upper spring being mounted on one of the support portions of the base, and means for connecting the upper attachment portion of the first upper spring to the upper attachment portion of the second upper spring.

46. An article of furniture which includes a furniture spring assembly according to claim 45 in combination with and connected to a said seat frame, a plurality of said spring assembles being located beside each other to provide a seat support.

47. An article of furniture according to claim 46 having transverse wires which connect together the attachment portions of said springs of different spring assemblies.

48. An article of furniture according to claim 46 having a border wire which is attached to and supported by said spring assemblies.

49. An article of furniture according to claim 48 wherein the upper attachment portion of at least one of said upper springs has a longitudinal section which is attached to the border wire to enhance the lateral stability of the spring assembly.

50. An article of furniture according to claim 49 having transverse wires which connect together the attachment portions of said springs of different spring assemblies to enhance further the lateral stability of said spring assemblies.

51. An article of furniture according to claim 49 having supplemental springs with lower portions mounted on the seat frame and upper portions connected to the border wire.

* * * * *